US011639727B2

(12) United States Patent
Chang

(10) Patent No.: US 11,639,727 B2
(45) Date of Patent: May 2, 2023

(54) TAIL GAS EXHAUSTING PRESSURE STABILIZATION CONTROL SYSTEM

(71) Applicant: Kinetics Technology Corporation, New Taipei (TW)

(72) Inventor: Chung-Hsiang Chang, New Taipei (TW)

(73) Assignee: KINETICS TECHNOLOGY CORPORATION, New Taipei (TW)

( * ) Notice: Subject to any disclaimer, the term of this patent is extended or adjusted under 35 U.S.C. 154(b) by 0 days.

(21) Appl. No.: 17/584,342

(22) Filed: Jan. 25, 2022

(65) Prior Publication Data

US 2022/0145908 A1 May 12, 2022

Related U.S. Application Data

(62) Division of application No. 16/917,372, filed on Jun. 30, 2020.

(51) Int. Cl.
*F04F 5/52* (2006.01)
*F04F 5/20* (2006.01)

(52) U.S. Cl.
CPC . *F04F 5/52* (2013.01); *F04F 5/20* (2013.01)

(58) Field of Classification Search
CPC ..... F04F 5/52; F04F 5/20
See application file for complete search history.

(56) References Cited

U.S. PATENT DOCUMENTS 3,367,255 A * 2/1968 Terp ..... B64D 13/04 454/73
3,441,045 A * 4/1969 Malone ..... B64D 13/00 417/189
4,285,466 A * 8/1981 Linscheid ..... B64D 13/04 236/13
2017/0072360 A1* 3/2017 Nasato ..... C01B 17/04

* cited by examiner

*Primary Examiner* — Connor J Tremarche
(74) *Attorney, Agent, or Firm* — Chun-Ming Shih; HDLS IPR Services

(57) ABSTRACT

A tail gas exhausting pressure stabilization control system is provided. The system can control the pressure and the flow rate of a gas and a driving gas inputted therein, such that when the gas and the driving gas are mixed and outputted to a tail gas exhausting outlet, the pressure thereof can be controlled under a predetermined pressure. Besides, when the back pressure is generated because of the exhausted gases from the outlet, an energy-saving module can adjust the pressure of the driving gas outputted to an eductor in accordance with the detecting result of the back pressure in order to resist the back pressure. Thus, the exhausted gases from the outlet can be still under the predetermined pressure between the gas and a gas distribution component so as to stabilize the pressure and flow rate of the exhausted gases from the outlet and save the driving gas.

5 Claims, 4 Drawing Sheets

TAIL GAS EXHAUSTING PRESSURE STABILIZATION CONTROL SYSTEM

This application is divisional application of U.S. patent application Ser. No. 16/917,372, filed on Jun. 30, 2020

BACKGROUND OF THE INVENTION

1. Field of the Invention

The present invention relates to a tail gas exhausting pressure stabilization system, in particular to a tail gas exhausting pressure stabilization system capable of stabilizing and maintaining the pressure and flow rate of the tail gas, and simultaneously save driving gas of a tail gas exhausting pressure stabilization system.

2. Description of the Prior Art

As the flow rate, pressure and composition of a working fluid may directly or indirectly influence the quality and production rate of products. Accordingly, in order to makes sure that the working fluid is used under a constant pressure, some technologies related to pressure control, flow rate control or fluid composition analysis may be applied to industrial manufacturing processes or machines to effectively control the working fluid.

For the purpose of effectively enhancing the efficiency, safety, production rate, quality and satisfying environmental-protection requirements, the target gas composition usually needs to be analyzed by a gas analyzer. In this way, the technician can understand the environmental condition of the target, and provide the solutions or improving methods accordingly to solve the above problems.

However, the gas is usually analyzed under normal temperature and pressure. In addition, back pressure may be generated at the moment of the gas being outputted from the gas analyzer; for the reason, the gas may not be effectively outputted from the gas analyzer, which may influence the analysis result. Currently, the technician usually inputs a driving gas (e.g. an inert gas) to assist the gas analyzer so as effectively exhausting the tail gas.

However, the currently available technologies cannot effectively control the flow rate or pressure of the tail gas. Moreover, the currently available technologies cannot effectively distribute the driving gas when the driving gas used to assisting in exhausting the tail gas, which may result in the waste of the driving gas or insufficiency of the driving gas. Therefore, it has become an important issue to provide a control system capable of controlling the flow rate and pressure of the tail gas, and effectively distributing the driving gas to save the driving gas in order to solve the disadvantage of prior art.

SUMMARY OF THE INVENTION

In order to solve the aforementioned problems, one objective of the present invention is to provide a tail gas exhausting pressure stabilization control system. The tail gas exhausting pressure stabilization control system controls the pressure and flow rate of a gas and a driving gas inputted therein, such that when the gas and the driving gas are mixed and outputted to a tail gas exhausting outlet, the pressure thereof can be controlled under a predetermined pressure. Besides, when the back pressure is generated because of the exhausted gases from the tail gas exhausting outlet or other factors, the pressure of the driving gas outputted to an eductor can be adjusted in accordance with the detecting result of the back pressure in order to further resist the back pressure. Thus, the gases from the tail gas exhausting system inlet can be still stably retained under the predetermined pressure of the gas so as to stabilize the pressure and flow rate of the gases from the tail gas exhausting system inlet and simultaneously save the driving gas. Accordingly, the present invention can improve the advantages of prior art.

To achieve the foregoing objective, the present invention provides a tail gas exhausting pressure stabilization control system, which is provided with a tail gas inlet, a driving gas supplying end and a tail gas exhausting outlet. The tail gas inlet receives a gas. The driving gas supplying end receives a driving gas. The tail gas exhausting outlet exhausts the gas and the driving gas or exhausts the gas and the driving gas after mixing. The tail gas exhausting pressure stabilization control system includes: a gas distribution component connected to the tail gas inlet to receive the gas; a flow stabilization module connected to the gas distribution component to receive the gas and control the flow rate of the gas outputted from the flow stabilization module; an eductor connected to the flow stabilization module and the tail gas exhausting outlet, wherein the eductor receives the gas and conveys the gas into the tail gas exhausting outlet; a driving gas flowing component connected to the driving gas supplying end to receive the driving gas; an energy-saving module connected to the driving gas flowing component and the eductor, wherein the energy-saving module receives the driving gas and adjusts the pressure of the driving gas outputted to the eductor in accordance with the detecting result of back pressure; an energy-saving pressure control loop, wherein one end thereof is connected to the energy-saving module and the other end thereof is connected to a tail gas exhausting hose between the eductor and the tail gas exhausting outlet, wherein the energy-saving pressure control loop receives the back pressure inputted by the tail gas exhausting hose and detects the back pressure, and the energy-saving module adjust the pressure of the driving gas in accordance with the detecting result of the back pressure; and a pressure regulation/distribution module connected to the driving gas flowing component and the energy-saving pressure control loop, wherein the pressure regulation/distribution module receives the driving gas from the driving gas flowing component and adjusts the pressure of the driving gas to an adjusted pressure and provides the driving gas to the energy-saving pressure control loop in order to convey the driving gas to the tail gas exhausting hose via the energy-saving pressure control loop.

Preferably, the eductor generates a corresponding vacuum pressure in accordance with the pressure of the driving gas. The educator utilizes the corresponding vacuum pressure to drawing the gas, then mixing the gas with the driving gas and conveying the mixing gas to the tail gas exhaust hose.

Preferably, the tail gas exhausting pressure stabilization control system further includes: a safety outlet connected to the gas distribution component, wherein a safety relief valve is disposed between the safety outlet and the gas distribution component, wherein when the gas pressure inside the safety relief valve is greater than an safety threshold value, the safety relief valve is turned on to exhaust the gas therefrom. This function is a safety mechanism.

Preferably, a gas stabilization/compensation valve is disposed between the safety relief valve and the gas distribution component. The gas stabilization/compensation valve is further connected to the pressure adjustment/distribution module to receive the gas from the gas distribution component or receive the driving gas from the pressure regulation/ distribution module. When the gas stabilization/compensation valve receives the gas, the gas stabilization/compensation valve outputs the gas to the safety relief valve. When the gas stabilization/compensation valve receives the driving gas, the gas stabilization/compensation valve adjusts the pressure of the driving gas to a compensation pressure so as to output the driving gas to the gas distribution component.

Preferably, the energy-saving module increases the pressure of the driving gas from the energy-saving module, whereby the pressure of the driving gas inputted into the energy-saving module is less than the pressure of the driving gas outputted from the energy-saving module.

Preferably, the tail gas exhausting pressure stabilization control system further includes: a pressure detecting component disposed on the gas distribution component to detect the gas pressure and determine whether the gas pressure is greater than the pressure threshold value set by the pressure detecting component in order to generate a signal in accordance with the detecting result; an exhausting control component connected to the pressure detecting component to receive the pressure signal; and a safety relief valve connected to the gas distribution component, wherein a safety relief valve is disposed on the gas distribution component, wherein when exhausting control component receives the determination from the pressure detecting component and shows that the gas pressure is greater than the pressure threshold, the exhausting control component turns on the safety relief valve, whereby the gas inside the gas distribution components passes through the safety relief valve to exhaust.

Preferably, the tail gas exhausting pressure stabilization control system further includes: a gas stabilization/compensation valve connected to the pressure adjustment/distribution module and the gas distribution component, wherein the gas stabilization/compensation valve receives the driving gas from the pressure adjustment/distribution module and adjusts the driving gas pressure as a make-up gas and outputs to the gas distribution component.

Preferably, the tail gas exhausting pressure stabilization control system further includes: an energy-saving pressure compensation module disposed on the energy-saving pressure control loop, wherein the energy-saving compensation module has a flow limiting micro-tube configured to receive the driving gas from the pressure regulation/distribution module in order to stabilize the driving gas pressure, wherein a check valve is between the flow limiting micro-tube and the tail gas exhausting hose, and the check valve is to avoid back pressure from the tail gas exhausting hose, driving gas exhausts to outlet instead.

Preferably, the tail gas exhausting pressure stabilization control system further includes a vacuum micro-regulation module, wherein one end thereof is connected to the energy-saving pressure control loop and the other end thereof is connected to the connection point between the flow stabilization module and the eductor, wherein the vacuum micro-regulation module receives a portion of the driving gas or the back pressure from the energy-saving pressure control loop in order to connect the driving gas or the back pressure and the gas outputted from the flow stabilization module to the eductor, whereby the eductor outputs the gas or the back pressure to the tail gas exhausting outlet.

In order to solve the aforementioned problems, another objective of the present invention is to provide a tail gas exhausting pressure stabilization control system for controlling the pressure and flow rate of a gas and a driving gas inputted therein. In this way, when the gas and the driving gas are mixed and outputted into a tail gas exhausting outlet, the pressure of the gas in the gas distribution component can be under a predetermine pressure with a view to stabilize and maintain the pressure and flow rate of the gas outputted from the tail gas exhausting outlet. Accordingly, the present invention can improve the shortcomings of prior art.

To achieve the foregoing objective, the present invention further provides a tail gas exhausting pressure stabilization control system, which is provided with a tail gas inlet, a driving gas supplying end and a tail gas exhausting outlet. The tail gas inlet receives a gas. The driving gas supplying end receives a driving gas. The tail gas exhausting outlet exhausts the gas and the driving gas or outputs the gas and the driving gas after mixing the gas and the driving gas. The tail gas exhausting pressure stabilization control system includes: a gas distribution component connected to the tail gas inlet to receive the gas; a flow stabilization module connected to the gas distribution component to receive the gas and control the flow rate of the gas outputted from the flow stabilization module; a pressurizing component connected to the flow stabilization module and the tail gas exhausting outlet, wherein the pressurizing component draws the gas outputted from the flow stabilization module and conveys the gas to the tail gas exhausting outlet; a driving gas flowing component connected to the driving gas supplying end to receive the driving gas; and a pressure regulation/distribution module, wherein one end thereof is connected to driving gas flowing component and the other end thereof is connected to the connection point between flow stabilization module and the pressurizing component, wherein the pressure regulation/distribution module receives the driving gas from the driving gas distribution component and adjusts the pressure of the driving gas to an adjusted pressure for the pressurizing component to draw the driving gas, whereby the driving gas and the gas are mixed with each other and exhausted to the tail gas exhausting outlet.

Preferably, the tail gas exhausting pressure stabilization control system further includes a bypass module of pressurizing component, wherein one end thereof is connected to the connection point between the flow stabilization module and the pressurizing component and the other end thereof is connected to the connection point between the pressurizing component and the tail gas exhausting outlet, wherein the bypass module of pressurizing component receives the gas, the driving gas or a mixed gas of the gas and the driving gas, outputted from the pressurizing component, and outputs the gas, the driving gas or the mixed gas to the connection point between the flow stabilization module and the pressurizing component after adjusting the flow rate thereof, whereby the pressurizing component receives the gas, the driving gas or the mixed gas again in order to form a loop.

Preferably, the tail gas exhausting pressure stabilization control system further includes a safety outlet connected to the gas distribution component, wherein a safety relief valve is disposed between the safety outlet and the gas distribution component, wherein when the gas pressure value of the gas inside the safety relief valve is greater than an exhausting threshold value, the safety relief valve is turned on to exhaust the gas therefrom.

Preferably, a gas stabilization/compensation valve is disposed between the safety relief valve and the gas distribution component. The gas stabilization/compensation valve is further connected to the pressure regulation/distribution module to receive the gas from the gas distribution component or receive the driving gas from the pressure regulation/distribution module. When the gas stabilization/compensation valve receives the gas, the gas stabilization/ compensation valve outputs the gas to the safety relief valve. When the flow stabilization/compensation valve receives the driving gas, the gas stabilization/compensation valve adjusts the pressure of the driving gas to a compensation pressure so as to output the driving gas to the gas distribution component.

Preferably, the tail gas exhausting pressure stabilization control system further includes: a pressure detecting component disposed on the gas distribution component to detect the gas pressure value of the gas and determine whether the gas pressure value recorded by the pressure signal thereof is greater than the pressure threshold value set by the pressure detecting component in order to generate a signal in accordance with the detecting result of the gas; an exhausting control component connected to the pressure detecting component to receive the signal; and a safety relief valve outlet connected to the gas distribution component, wherein a safety relief valve is disposed between the safety outlet and the gas distribution component, wherein when exhausting control component receives the determination from the pressure detecting component and the determination shows that the gas pressure value is greater than the pressure threshold value, the exhausting control component turns on the safety relief valve, whereby the gas inside the gas distribution components passes through the safety relief valve and is exhausted via the safety outlet.

Preferably, the tail gas exhausting pressure stabilization control system further includes: a vacuum regulation component disposed between the pressure regulation/distribution module and the pressurizing component, wherein the vacuum regulation component adjusts the gas pressure value of a tail gas exhausting hose between the vacuum regulation component and the pressurizing component to an adjustment threshold value.

BRIEF DESCRIPTION OF THE DRAWINGS

For a better understanding of the aforementioned embodiments of the invention as well as additional embodiments thereof, reference should be made to the Description of Embodiments below, in conjunction with the following drawings in which like reference numerals refer to corresponding parts throughout the figures.

DETAILED DESCRIPTION OF THE PREFERRED EMBODIMENT

The following description is about embodiments of the present invention; however it is not intended to limit the scope of the present invention.

Figure 1:
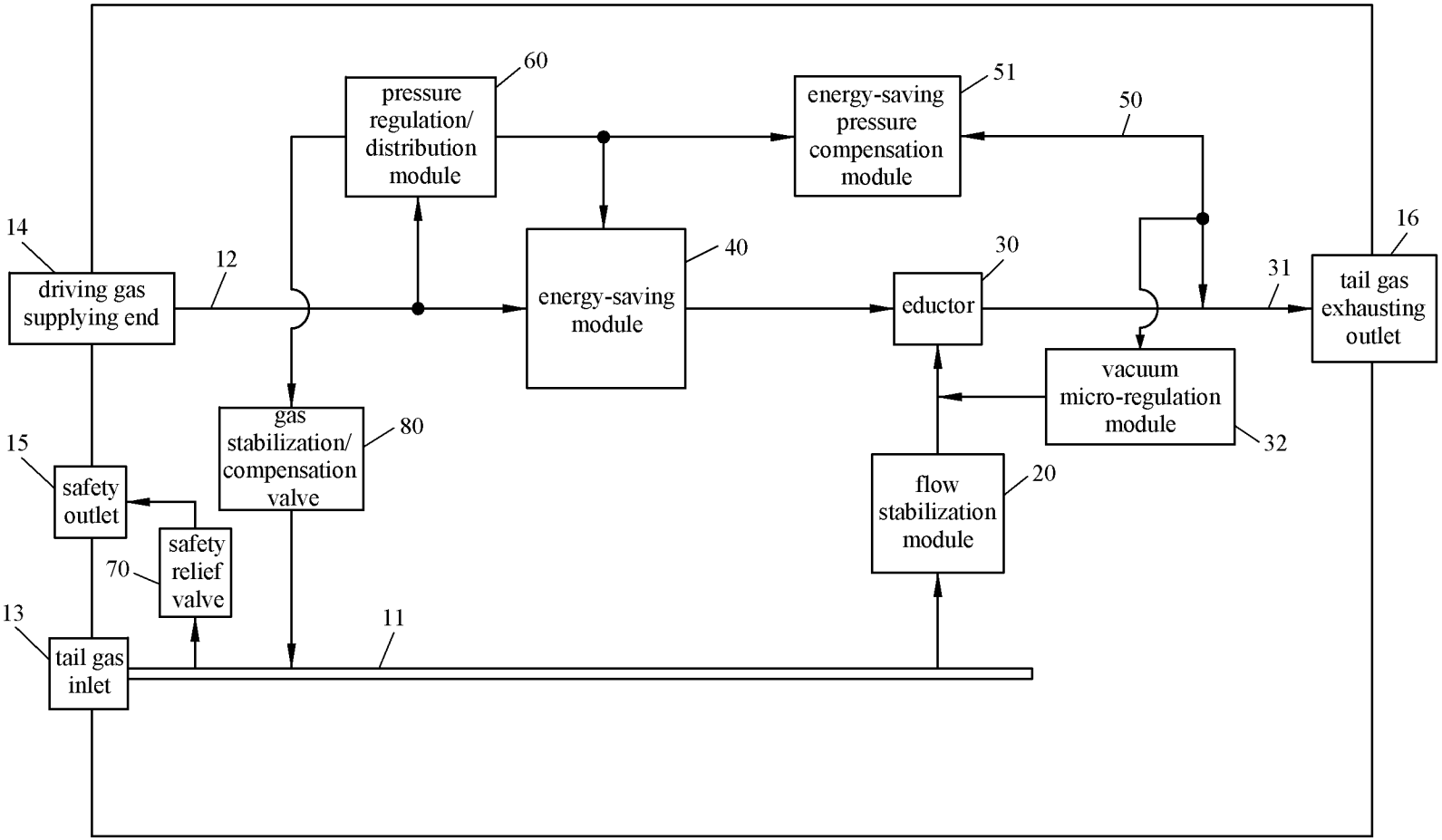
FIG. 1 is a block diagram of a tail gas exhausting pressure stabilization control system in accordance with a first embodiment of the present invention.

Please refer to FIG. 1, which is a block diagram of a tail gas exhausting pressure stabilization control system in accordance with a first embodiment of the present invention. The first embodiment of the present invention discloses a gas distribution component 11, a flow stabilization module 20, an eductor 30, a vacuum micro-regulation module 32, a driving gas flowing component 12, an energy-saving module 40, an energy-saving pressure control loop 50, an energy-saving pressure compensation module 51, a pressure regulation/distribution module 60, a safety relief valve 70 and a flow stabilization/compensation valve 80. The gas distribution component 11 is configured to guide the gas. The flow stabilization module 20 is configured to control the output amount of the gas. The eductor 30 is configured to output the gas to the outlet. The driving gas flowing component 12 is configured to guide the driving gas (an inert gas, such as nitrogen). The energy-saving module 40 is configured to adjust the pressure of the driving gas outputted in accordance with the detecting result of the back pressure. The energy-saving pressure control loop 50 is configured to output the driving gas and the back pressure. The pressure regulation/distribution module 60 is configured to adjust the pressure of the driving gas and output the driving gas. The safety relief valve 70 is configured to exhaust the gas with excessively high pressure from the outlet.

In addition, the tail gas exhausting pressure stabilization control system of the present invention is provided with a tail gas inlet 13, a driving gas supplying end 14, a safety outlet 15 and a tail gas exhausting outlet 16 in order to connect the above components with each other. More specifically, the tail gas inlet 13 is configured to receive a gas. The driving gas supplying end 14 is configured to receive a driving gas. The safety outlet 15 is configured to exhaust the gas or the driving gas when the pressure thereof is excessively high. The tail gas exhausting outlet 16 is configured to output the gas and the driving gas or output the mixed gas of the gas and the driving gas.

Since the present invention has two flow paths for the gas and the driving gas respectively. The following will describe the two flow paths respectively.

Gas:

The gas distribution component 11 is connected to the tail gas inlet 13 to receive the gas.

The flow stabilization module 20 is connected to the gas distribution component 11 to receive the gas. The flow stabilization module 20 mainly uses the needle valve to control the flow rate (e.g. 5-30 L/min) of the gas outputted from the flow stabilization module 20 in order to stably output the gas.

The eductor 30 is connected to the flow stabilization module 20 and the tail gas exhausting outlet 16 so as to receive the gas outputted from the flow stabilization module 20 and convey the gas to the tail gas exhausting outlet 16 via a tail gas exhausting hose 31.

The safety relief valve 70 is disposed between the safety outlet 15 and the gas distribution component 11. When the gas pressure value of the gas inside the safety relief valve 70 is greater than an exhausting threshold value (e.g. ⅓ psiG (psi Gauge)), the safety relief valve 70 is turned on and the gas can be exhausted via the safety outlet 15. As the pressure of the gas inside the gas distribution component 11 is excessively high, the equipment connected to the gas distribution component may be damaged or a danger may be caused. The safety relief valve 70 and the safety outlet 15 can stabilize the pressure of the gas inside the gas analyzer connected to the tail gas exhausting pressure stabilization control system in order to avoid the above situation.

Driving Gas:

The driving gas flowing component 12 is connected to the driving gas supplying end 14 to receive the driving gas. When the energy-saving module 40 detects a back pressure, the energy-saving module 40 adjusts the pressure of the driving gas outputted to the eductor 30 in accordance with the detecting result of the back pressure. Besides, the energy-saving module 40 can increase the pressure of the driving gas, such that the pressure of the driving gas inputted into the energy-saving module 40 can be less than the pressure of the driving gas outputted from the energy-saving module 40 (e.g. 1:6). In this way, when the pressure of the outputted driving gas is increases, the flow rate of the outputted driving gas is also increased accordingly. Thus, the pressure of the driving gas and the flow rate thereof can be effectively saved via the adjustment in accordance with the detecting result of the driving gas and/or the pressure increasing function of the energy-saving module 40.

When the driving gas is inputted into the eductor 30, a corresponding pressure is generated. Therefore, when the eductor 30 receives the pressure provided by the driving gas, a corresponding vacuum pressure is generated. Thus, the eductor 30 can draw the corresponding gas via the vacuum pressure, such that a mixed gas is formed by mixing the gas with the pressure gas and the mixed gas is exhausted to the tail gas exhausting outlet 16.

The pressure regulation/distribution module 16 is connected to the driving gas flowing component 12 in order to receive the driving gas from the driving gas flowing component 12. Then, the pressure regulation/distribution module 60 adjusts the pressure of the driving gas to an adjusted pressure (e.g. 20 psiG) and then outputs the driving gas.

The energy-saving pressure control loop 50 is connected to the pressure regulation/distribution module 60, the energy-saving module 40 and the tail gas exhausting hose 31. The energy-saving pressure control loop 50 receives the driving gas, outputted by the pressure regulation/distribution module 60, from the energy-saving pressure compensation module 51, and outputs the driving gas to the tail gas exhausting hose 31. Accordingly, the driving gas and the mixed gas outputted by the eductor 30 can be outputted at the same time. However, when the mixed gas is outputted to the tail gas exhausting outlet 16, the back pressure is (or is not) applied to the tail gas exhausting outlet 16; thus, when the back pressure exists, the back pressure would press the tail gas exhausting outlet 16 in the direction toward the tail gas exhausting hose 31. Accordingly, the energy-saving pressure compensation module 51 receives the back pressure from the tail gas exhausting hose 31 via the energy-saving pressure control loop 50 for the energy-saving module 40 detects the back pressure and generates the detecting result of the back pressure.

Further, the energy-saving pressure control loop 50 is further provided with the energy-saving pressure compensation module 51 and the energy-saving pressure compensation module 51 includes a flow limiting micro-tube. The flow limiting micro-tube receives the driving gas from the pressure regulation/distribution module 60 with a view to stabilize the pressure of the driving gas. A back-pressure valve is disposed between the micro-pipe flow limiting and the tail gas exhausting hose 31 so as to receive the driving gas outputted by the flow limiting micro-tube and then output the driving gas to the tail gas exhausting hose 31. Thus, the back-pressure valve is used to unidirectionally output the driving gas to the tail gas exhausting hose 31. However, if the energy-saving pressure control loop 50 is pressed inward after receiving the back pressure, the back-pressure valve can further prevent the back pressure from be applied toward the flow limiting micro-tube. When the back pressure presses the output of the back-pressure valve, the driving gas needing to be outputted from the back-pressure valve cannot be successfully outputted because of the back pressure. Therefore, the pressure of the driving gas between the pressure regulation/distribution module 60 and the energy-saving pressure compensation module 51 would gradually increase because the driving gas cannot be outputted. At the moment, the energy-saving module 40 can detect the increased pressure of the driving gas so as to indirectly detect the increased pressure force due to the back pressure. In this way, the energy-saving module 40 can detect the back pressure (either by direction detection or indirect detection) to generate the detecting result of the back pressure in order to adjust the pressure of the driving gas outputted to the eductor 30 and then resist the back pressure.

Moreover, the present invention further provides a vacuum micro-regulation module 32 and a gas stabilization/compensation valve 80. The vacuum micro-regulation module 32 is majorly used to balance the pressure between the gas and the driving gas. The gas stabilization/compensation valve 80 is majorly used to compensate for the output flow rate of the gas in order to avoid that a vacuum space is gradually formed in the gas distribution component 11 because the flow rate of the gas is insufficient.

One end of the vacuum micro-regulation module 32 is connected to the energy-saving pressure control loop 50 and the other end thereof is connected to the connection point between the flow stabilization module 20 and the eductor 30. Accordingly, the vacuum micro-regulation module 32 can receive a portion of the driving gas or the back pressure from the energy-saving pressure control loop 50 so as to convey the driving gas or the back pressure to the eductor 30 via the gas outputted from the flow stabilization module 20. Therefore, the eductor 30 can output the driving gas or the back pressure to the tail gas exhausting outlet for the purpose of achieving pressure balance.

The gas stabilization/compensation valve 80 is connected to the pressure regulation/distribution module and the gas distribution component 11 so as to receive the driving gas form the pressure regulation/distribution module 60. Then, the gas stabilization/compensation valve 80 adjusts the pressure of the driving gas to a compensation pressure (e.g. 1 inch-WC) and outputs the driving gas to the gas distribution component 11. More specifically, if the original flow rate of the gas distribution component 11 is 5 L/min and the tail gas inlet 13 can only provide the gas by the flow rate of 4 L/min, the gas distribution component 11 would gradually generate some vacuum pressure because its original flow rate of 5 L/min is not satisfied. In this case, since the gas stabilization/compensation valve 80 has received the driving gas from the pressure regulation/distribution module 60 and performed the relevant pressure adjustment operations (if the pressure adjustment operations fail to be made, the driving gas may not effectively provide the compensation function for the gas), the gas distribution component 11 can receive the driving gas from the gas stabilization/compensation valve 80 to make up the shortage (1 L/min) of the flow rate of the gas so as to achieve compensation effect.

In accordance with the above embodiment, the present invention can effectively stabilize and maintain the pressure and flow rate of the gas of the tail gas exhausting outlet 16 and the gas distribution component 11, and simultaneously save the driving gas.

Figure 2:
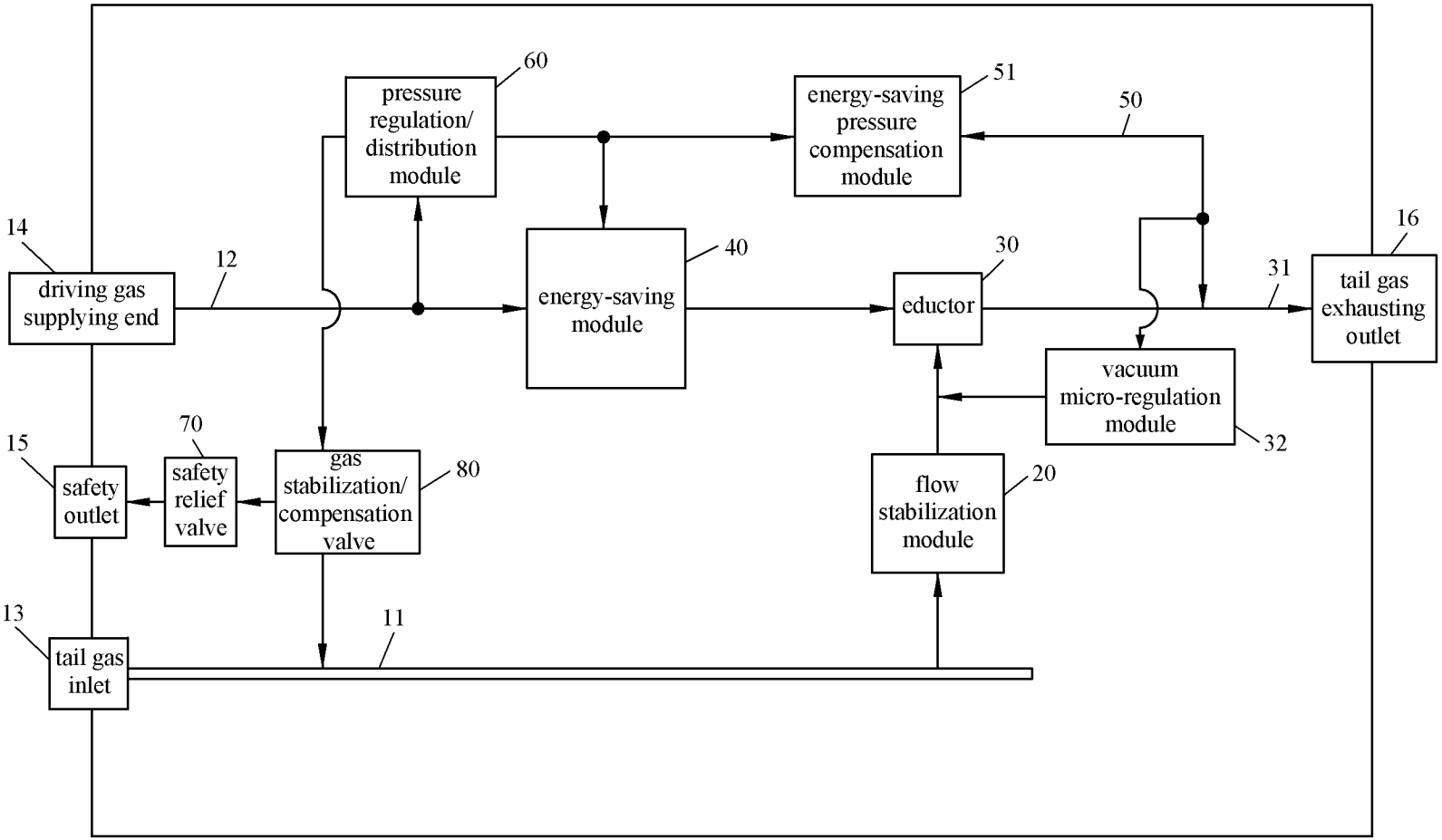
FIG. 2 is a block diagram of a tail gas exhausting pressure stabilization control system in accordance with a second embodiment of the present invention.
Figure 3:
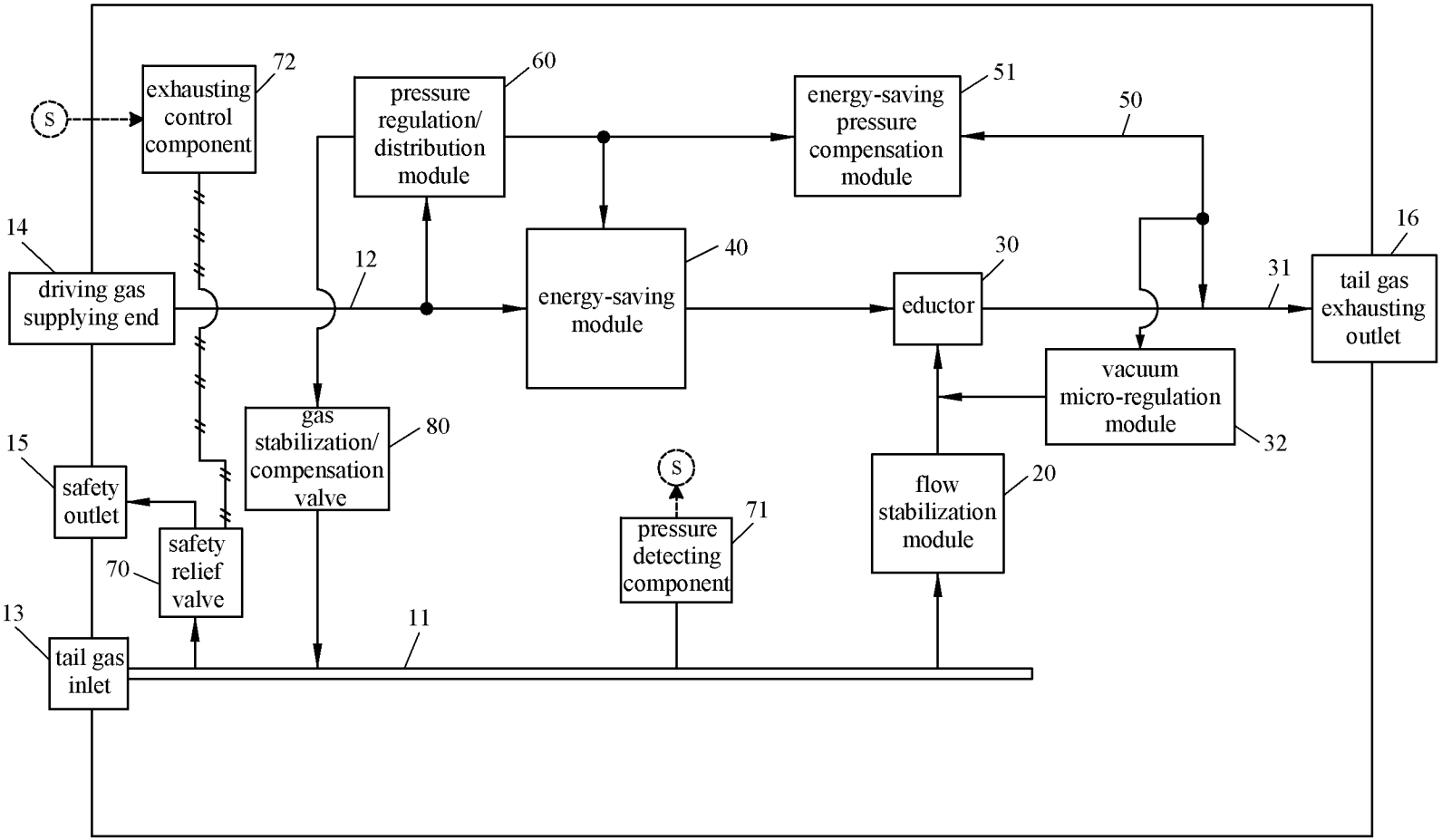
FIG. 3 is a block diagram of a tail gas exhausting pressure stabilization control system in accordance with a third embodiment of the present invention.

Please refer to FIG. 2 and FIG. 3. FIG. 2 is a block diagram of a tail gas exhausting pressure stabilization control system in accordance with a second embodiment of the present invention; FIG. 3 is a block diagram of a tail gas exhausting pressure stabilization control system in accordance with a third embodiment of the present invention. As shown in FIG. 2 and FIG. 3, the layout of the second embodiment and the third embodiment is similar to the layout of the first embodiment. The main difference between these embodiments and the first embodiment is the arrangement of the components for gas compensation or exhausting gas, which will be specified in the following content:

Second Embodiment (as Shown in FIG. 2)

In the second embodiment, the arrangement of the components for gas compensation and exhausting gas is different from that of the first embodiment. More specifically, the safety relief valve 70 is disposed between the gas stabilization/compensation valve 80 and the safety outlet 15. The gas stabilization/compensation valve 80 is disposed between the pressure regulation/distribution module 60, the gas distribution component 11 and the safety relief valve 70, such that the gas stabilization/compensation valve 80, the pressure regulation/distribution module 60 and the gas distribution component 11 are connected to the safety relief valve 70. Thus, the safety relief valve 70 cannot directly receive the gas, but can receive the gas via the gas stabilization/compensation valve 80 and output the gas to the safety relief valve 70.

The gas stabilization/compensation valve 80 is used to receive the driving gas from the pressure regulation/distribution module 60 via the gas stabilization/compensation valve 80 when the flow rate of the gas in the gas distribution component 11 is insufficient. Then, the gas stabilization/compensation valve 80 can provide the driving gas for the gas distribution component 11 in order to compensate for the shortage of the flow rate of the gas. On the contrary, if the gas in the gas distribution component 11 is too much and exceeds the compensation pressure set by the gas stabilization/compensation valve 80 (e.g. 1 inch-WC), the gas in the gas distribution component 11 would be pressed in the direction toward the gas stabilization/compensation valve 80. Meanwhile, the safety relief valve 70 can receive the gas in order to determine whether the gas pressure value of the gas is greater than the exhausting threshold value (e.g. 7 inch-WC). If it is, the safety relief valve 70 is turned on and then the gas can pass through the safety relief valve 70 and be exhausted from the safety outlet 15.

As described above, in accordance with the arrangement of the second embodiment, the pressure value setting of the compensation pressure is usually less than the safety pressure setting of the exhausting threshold value, which can just achieve the compensation and gas exhausting effects by the same pipeline.

Third Embodiment (as Shown in FIG. 3)

In the third embodiment, the arrangement of the components for exhausting gas is different from that of the first embodiment. More specifically, the third embodiment further includes a pressure detecting component 71 and an exhausting control component 72. The pressure detecting component 71 is majorly used to detect the pressure and determines whether the pressure is greater than the exhausting threshold value; then, the pressure detecting component 71 generates a signal S and transmits the signal S. The exhausting control component 72 is majorly used to determine whether to turn on the safety relief valve 70 in accordance with the received signal S.

Further, the pressure detecting component 71 is disposed on the gas distribution component 11 and wiredly or wirelessly connected to the exhausting control component 72 so as to detect the gas pressure value in the gas distribution component 11. Besides, the pressure detecting component 71 can generate the signal S in accordance with the detecting result and then transmits the signal S to the exhausting control component 72.

The exhausting control component 72 is further connected to the safety relief valve 70. When the gas pressure value of the gas received by the exhausting control component 72 is greater than the signal S of the exhausting threshold value, the exhausting control component 72 turns on the safety relief value 70, such that the gas in the gas distribution component 11 passes through the safety relief valve 70 and is exhausted from the safety outlet 15.

As set forth above, both of the second embodiment and the third embodiment can effectively stabilize and maintain the pressure and flow rate of the gas of the tail gas exhausting outlet 16 and the gas distribution component 11, and simultaneously save the driving gas.

Figure 4:
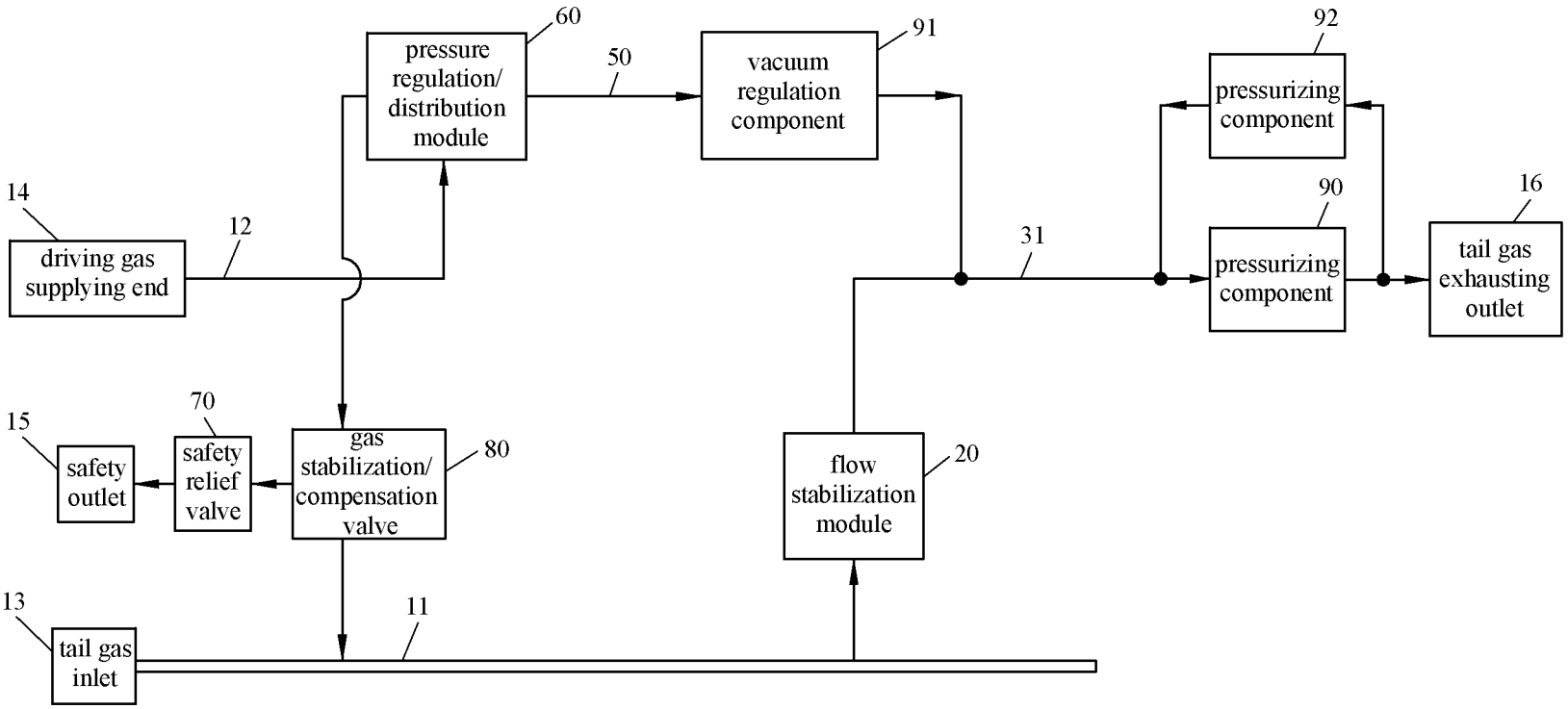
FIG. 4 is a block diagram of a tail gas exhausting pressure stabilization control system in accordance with a fourth embodiment of the present invention.

Please refer to FIG. 4, which is a block diagram of a tail gas exhausting pressure stabilization control system in accordance with a fourth embodiment of the present invention. As shown in FIG. 4, the fourth embodiment does not include the energy-saving module, the eductor, the energy-saving pressure compensation module and the vacuum micro-regulation module. However, the fourth embodiment further includes a pressurizing component 90, a vacuum regulation component 91 and a bypass module of pressurizing component 92. Preferably, the pressurizing component 90 is a diaphragm-type gas pump, which can draw the gas and exhaust the gas. Preferably, the vacuum regulation component 91 is a vacuum regulator, which can adjust the negative pressure in the pipeline in order to keep the negative pressure of the pipeline under a negative threshold value and realize the pressure balance of the pipeline. The bypass module of pressurizing component 92 can receive the outputted gas and convey the gas to the other end in order to form a loop.

Furthermore, the pressurizing component 90 is connected to the flow stabilization module 20 and the tail gas exhausting outlet 16. The pressurizing component 90 can draw the gas outputted by the flow stabilization module 20 and convey the gas to the tail gas exhausting outlet 16.

The vacuum regulation component 91 is disposed between the pressure regulation/distribution module 60 and the pressurizing component 90 with a view to adjust the gas pressure value of the tail gas exhausting hose 31 between the vacuum regulation component and the pressurizing component 90 to an adjustment threshold value (e.g. the adjustment threshold value may be −6"HG). The gas may be outputted by the flow stabilization module 20 to the pressurizing component 90 under a negative pressure (e.g. −6"HG). Therefore, if the pressure of the tail gas exhausting hose 31 is adjusted to −6"HG, the pressure of the driving gas outputted to the pressurizing component 90 can be effectively stabilized.

One end (the first end) of the bypass module of pressurizing component 92 is connected to the connection point between the flow stabilization module 20 and the pressurizing component 90, and the other end thereof (the second end) is connected to the connection point between the pressurizing component 90 and the tail gas exhausting outlet 16. Thus, when the pressurizing component 90 outputs the gas, the driving gas or the mixed gas (the following content takes the mixed gas as an example), the mixed gas returns from the second end of the bypass module of pressurizing component 92 to the first end of the bypass module of pressurizing component 92. When the mixed gas returns to the bypass module of pressurizing component 92, the bypass module of pressurizing component 92 can further control the flow rate of the mixed gas and then output the mixed gas to the first end of the bypass module of pressurizing component 92, such that the pressurizing component 90 receives the mixed gas again to form the loop in order to balance the pressure between the front end and the rear end of the pressurizing component 90.

In accordance with the embodiments set forth above, the tail gas exhausting pressure stabilization control system in accordance with the present invention can actually stabilize and maintain the pressure and flow rate of the gas, and can simultaneously save the driving gas.

The above disclosure is related to the detailed technical contents and inventive features thereof. Those skilled in the art may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A tail gas exhausting pressure stabilization control system, provided with a tail gas inlet configured to receive a gas, a driving gas supplying end configured to receive a driving gas and a tail gas exhausting outlet configured to output the gas and the driving gas or output the gas and the driving gas after mixing the gas and the driving gas, wherein the tail gas exhausting pressure stabilization control system is characterized in comprising:

a gas distribution component, connected to the tail gas inlet to receive the gas;

a flow stabilization module, connected to the gas distribution component to receive the gas and control a flow rate of the gas outputted from the flow stabilization module;

a pressurizing component, connected to the flow stabilization module and the tail gas exhausting outlet, wherein the pressurizing component draws the gas outputted from the flow stabilization module and conveys the gas to the tail gas exhausting outlet;

a driving gas flowing component, connected to the driving gas supplying end to receive the driving gas; and a pressure regulation/distribution module, wherein one end thereof is connected to driving gas flowing component and the other end thereof is connected to a connection point between the flow stabilization module and the pressurizing component, wherein the pressure regulation/distribution module receives the driving gas from the driving gas flowing component and adjusts a pressure of the driving gas to an adjusted pressure for the pressurizing component to draw the driving gas, whereby the driving gas and the gas are mixed with each other and outputted to the tail gas exhausting outlet.

2. The tail gas exhausting pressure stabilization control system of claim 1, further comprising a return loop of pressurizing component, wherein one end thereof is connected to the connection point between the flow stabilization module and the pressurizing component and the other end thereof is connected to a connection point between the pressurizing component and the tail gas exhausting outlet, wherein the return loop of pressurizing component receives the gas, the driving gas or a mixed gas of the gas and the driving gas, outputted from the pressurizing component, and outputs the gas, the driving gas or the mixed gas to the connection point between the flow stabilization module and the pressurizing component after adjusting the flow rate thereof, whereby the pressurizing component receives the gas, the driving gas or the mixed gas again in order to form a loop.

3. The tail gas exhausting pressure stabilization control system of claim 1, further comprising a safety outlet connected to the gas distribution component, wherein a safety relief valve is disposed between the safety outlet and the gas distribution component, wherein when a gas pressure value of the gas inside the safety relief valve is greater than an exhausting threshold value, the safety relief valve is turned on to exhaust the gas therefrom.

4. The tail gas exhausting pressure stabilization control system of claim 3, wherein a gas stabilization/compensation valve is disposed between the safety relief valve and the gas distribution component, wherein the gas stabilization/compensation valve is further connected to the pressure regulation/distribution module to receive the gas from the gas distribution component or receive the driving gas from the pressure regulation/distribution module, wherein when the gas stabilization/compensation valve receives the gas, the gas stabilization/compensation valve outputs the gas to the safety relief valve, wherein when the gas stabilization/compensation valve receives the driving gas, the gas stabilization/compensation valve adjusts the pressure of the driving gas to a compensation pressure so as to output the driving gas to the gas distribution component.

5. The tail gas exhausting pressure stabilization control system of claim 1, further comprising a vacuum regulation component disposed between the pressure regulation/distribution module and the pressurizing component, wherein the vacuum regulation component adjusts a gas pressure value of a tail gas exhausting hose between the vacuum regulation component and the pressurizing component to an adjustment threshold value.

* * * * *